US009315352B2

(12) United States Patent
Nelson

(10) Patent No.: US 9,315,352 B2
(45) Date of Patent: Apr. 19, 2016

(54) BRAKE TO FACILITATE DISPENSING OF MATERIAL FROM A ROLL

(71) Applicant: Encore Packaging LLC, Lake Bluff, IL (US)

(72) Inventor: Timothy H. Nelson, Winnetka, IL (US)

(73) Assignee: Encore Packaging LLC, Lake Bluff, IL (US)

( * ) Notice: Subject to any disclaimer, the term of this patent is extended or adjusted under 35 U.S.C. 154(b) by 226 days.

(21) Appl. No.: 14/041,164

(22) Filed: Sep. 30, 2013

(65) Prior Publication Data

US 2015/0090833 A1 Apr. 2, 2015

(51) Int. Cl.

| | |
|---|---|
| ***B65H 23/06*** | (2006.01) |
| ***B65H 23/08*** | (2006.01) |
| ***B65H 16/00*** | (2006.01) |
| ***B65H 20/02*** | (2006.01) |

(52) U.S. Cl.

CPC ..... *B65H 23/08* (2013.01); *B65H 16/005* (2013.01); *B65H 20/02* (2013.01); *B65H 2402/542* (2013.01); *B65H 2404/54* (2013.01); *B65H 2404/62* (2013.01)

(58) Field of Classification Search

CPC ..... B65H 73/053; B65H 73/08; B65H 20/02
USPC ..... 242/422, 422.4, 419.4, 419.1, 418.1, 242/416

See application file for complete search history.

(56) References Cited

U.S. PATENT DOCUMENTS

| | | | | |
|---|---|---|---|---|
| 1,629,029 | A * | 5/1927 | Garbutt | 242/421.9 |
| 3,222,008 | A * | 12/1965 | Purzycki | 242/420.4 |
| 3,595,492 | A * | 7/1971 | Furst | 242/419.4 |
| 3,826,443 | A * | 7/1974 | Goodley | 242/421.9 |
| 3,899,143 | A * | 8/1975 | Slezak | 242/156.2 |
| 4,454,974 | A * | 6/1984 | Cooke | 225/106 |
| 5,344,058 | A * | 9/1994 | Baffo | 226/181 |
| 8,490,366 | B1 * | 7/2013 | Hintz | 53/64 |

* cited by examiner

*Primary Examiner* — Sang Kim
(74) *Attorney, Agent, or Firm* — Fitch, Even, Tabin & Flannery LLP

(57) ABSTRACT

A rolled material dispenser includes a brake mechanism designed to govern the rolling of a roll of packing material during dispensing of the packing material to reduce unintended tearing of the packing material and improve the user experience of handling such material dispensing. In one example, the brake mechanism includes a first portion configured to engage the roll during normal unloading of material from the roll and a second portion configured to engage the roll to impede rotation of the roll when unloading of material is uneven. An idler roller engages the material being dispensed, which idler roller may be resiliently supported to absorb forces on the material.

12 Claims, 7 Drawing Sheets

BRAKE TO FACILITATE DISPENSING OF MATERIAL FROM A ROLL

TECHNICAL FIELD

The invention relates generally to the controlling dispensing of material from a roll, and more specifically, dispensing packaging material from a roll.

BACKGROUND

Various sheet-type materials are provided in roll form for easy storage, shipping, and dispensing for use. In the packing material industry, for example, Kraft paper is crumpled and used to fill empty portions of shipped containers. In various applications, it is advantageous to have the material be unrolled and crumpled in a continuous and easy manner to facilitate quick and efficient packing of objections for shipping.

Devices exist that facilitates fast crumpling of the packing material as it is dispensed from the roll by passing the material through a relatively small passage. The engagement of the material with the passage crumples the paper for the user to then quickly apply to the shipped load. Rolls of packing material such as Kraft paper, however, are generally not uniform in their form. For example, typical Kraft paper rolls are wound around a cylindrical core. This core, however, may not have perfectly near circular circumference, either through manufacturing or through the handling of the roll before it is disposed for dispensing the material. Then, when that core is disposed on a support around which the roll will rotate during dispensing of the packing material, the roll will have an uneven rotation rate. For instance, the roll may rotate at a first rate until a flat portion of the core engages the roll's support, at which time the roll may slip and rotate quickly and then stop suddenly. Such motion can cause a tear in the packing material, which can render that portion of the material unsuitable for the packing task at hand.

SUMMARY

Generally speaking and pursuant to these various embodiments, a rolled material dispenser includes a brake mechanism designed to govern the rolling of a roll of packing material during dispensing of the packing material to reduce unintended tearing of the packing material or improve the user experience of handling such material dispensing. In one example, the brake mechanism includes a first portion configured to engage the roll during normal unloading of material from the roll and a second portion configured to engage the roll to impede rotation of the roll when unloading of material is uneven.

In one example, the brake mechanism is biased to engage the roll with a brake structure to impede roll rotation. When the packing material is tensioned such as when paper is pulled from the roll, the tensioned paper effects removal of the brake mechanism from engagement with the roll. If during the dispensing of paper the roll rotates unevenly or for another reason the paper tension reduces, the reduced tension allows the brake mechanism to re-engage the roll to slow and/or stop its rotation. So configured, uneven rolling of the packing material is restrained to reduce the amount of unwanted tearing of the material and to improve the user experience. These and other benefits may become clearer upon making a thorough review and study of the following detailed description.

BRIEF DESCRIPTION OF THE DRAWINGS

The above needs are at least partially met through provision of the brake to facilitate dispensing of material from a roll described in the following detailed description, particularly when studied in conjunction with the drawings, wherein.

Figure 1:
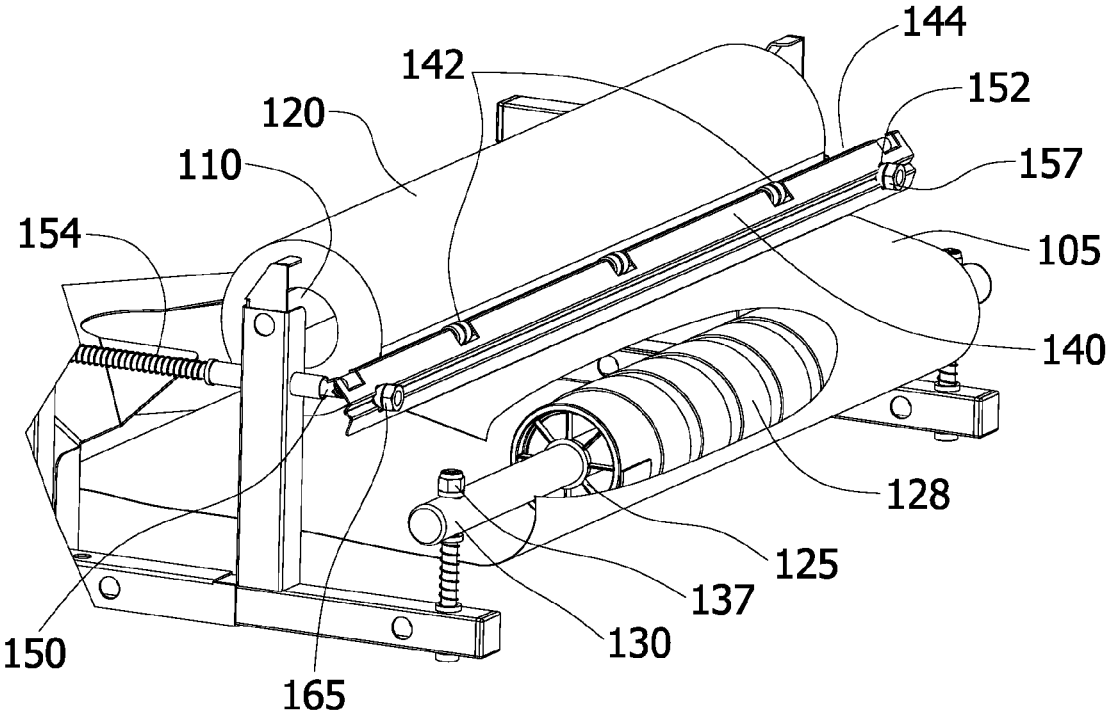
FIG. 1 comprises a perspective view of an example packaging material dispenser in accordance with various embodiments.
Figure 2:
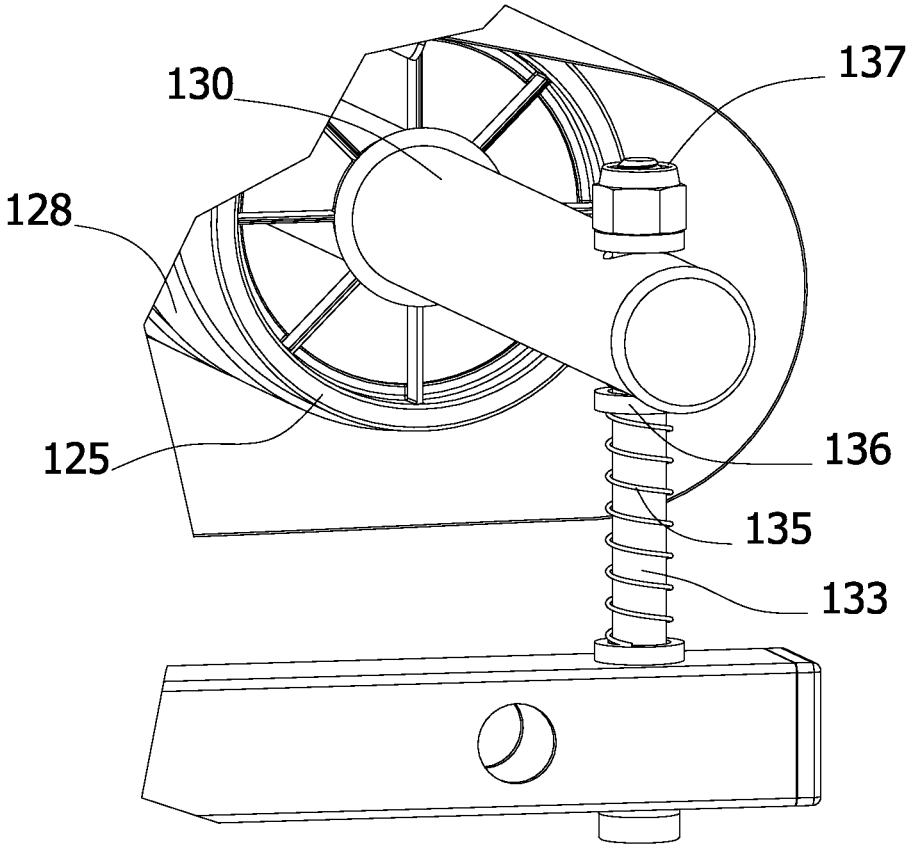
FIG. 2 comprises a perspective view of the idler roller and corresponding support for the example packaging material dispenser of FIG. 1.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Referring now to the drawings and, in particular to FIGS. 1-6, an example apparatus 100 for dispensing packing material 105 will be described. In the illustrated example, the apparatus 100 includes a support arm 110 configured to support a roll 120 of packing material 105. Typically, the packing material 105 will be craft paper or a similar paper used for packing in the shipping industry. Other packing material is possible such as sheets of foam and the like. The support arm 110 may include a rotatable component 115 configured to engage the inside of the roll 120 to rotate as the roll 120 rotates with dispensing of the packaging material 105.

The packaging material dispensing apparatus 100 also includes an idler roller 125 configured to engage and roll with the packing material 105 dispensed from the roll 120. The idler roller 125 may include a surface portion 128 on all or part of its outer cylindrical surface. This surface portion 128 has a relatively high tackiness or outer surface friction such that the surface portion 128 engages the packing material 105 when the packing material is being pulled from the packaging material dispenser. As the packaging material is pulled from the dispenser, it separates from the roll 120 and passes over and around the idler roller 125. The surface portion 128 of the idler roller 125 engages the packaging material 105 such that the idler roller 125 rolls together with and at generally the same speed as the packaging material 105 as it is dispensed from the roll 120.

The idler roller 125 is supported on a rod 130. The rod 130 is optionally spring supported such that the forces of tension on the packaging material 105 in the direction around the idler roller 125 is somewhat absorbed by the support to avoid unnecessary tearing of the packaging material 105 when being pulled around the idler roller 125. In the illustrated example, the support includes a post 133 around which a spring 135 extends. The spring 135 engages a washer 136, which washer 136 supports the weight of the rod 130 thereby supporting also the weight of the idler roller 125. Accordingly, the spring 135 absorbs at least some of the downward forces applied to it during the dispensing of packaging material 105 around the idler roller 125. The tension on the spring 135 can be adjusted by rotation of the nut 137 disposed opposite of the spring 135 relative to the support rod 130. The absorption of forces on the idler roller 125 takes some of the forces off of the packaging material 105 such that the packaging material 105 is less likely to tear on application of certain forces.

In the illustrated example, a brake arm 140 is disposed to extend along the length of the roll 120 to engage the roll 120 with at least one brake arm roller 142 during dispensing of packaging material 105 from the roll 120. In the illustrated example, the brake arm 140 includes a first edge 144 that supports the at least one brake arm roller 142. Three rollers 142 are illustrated in this example, although any number of rollers can be used based upon the length of the roll of packaging material and/or the type of packaging material. The brake arm 140 also includes a second edge 146 of the brake arm 140 disposed opposite of the first edge 144. This second edge 146 with the brake arm 140 comprises a brake edge 146, wherein the brake arm 140 is configured to engage the roll 120 with the brake edge 146 in response to uneven rolling of the roll 120 on the support arm 110.

Figure 3:
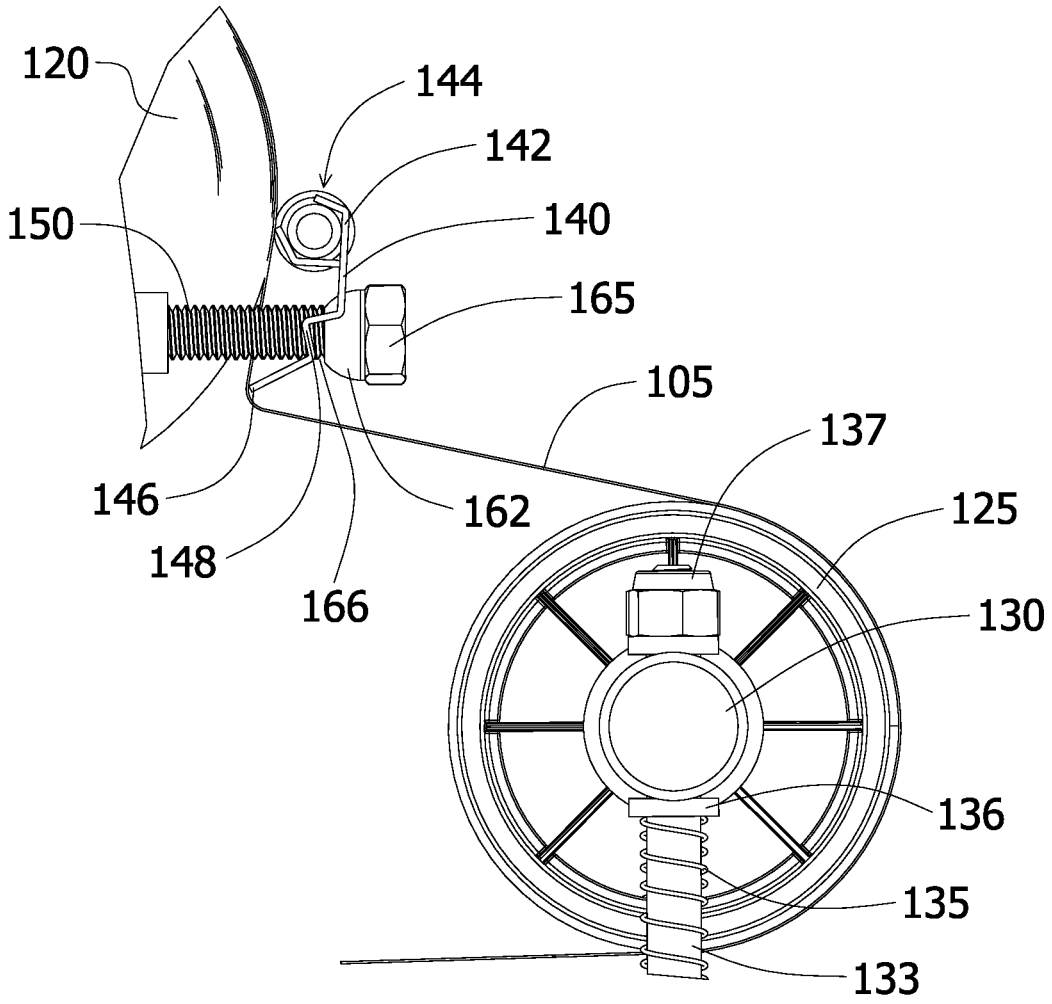
FIG. 3 comprises a side view of the brake arm with a brake edge engaging the roll of the example packaging material dispenser of FIG. 1.
Figure 5:
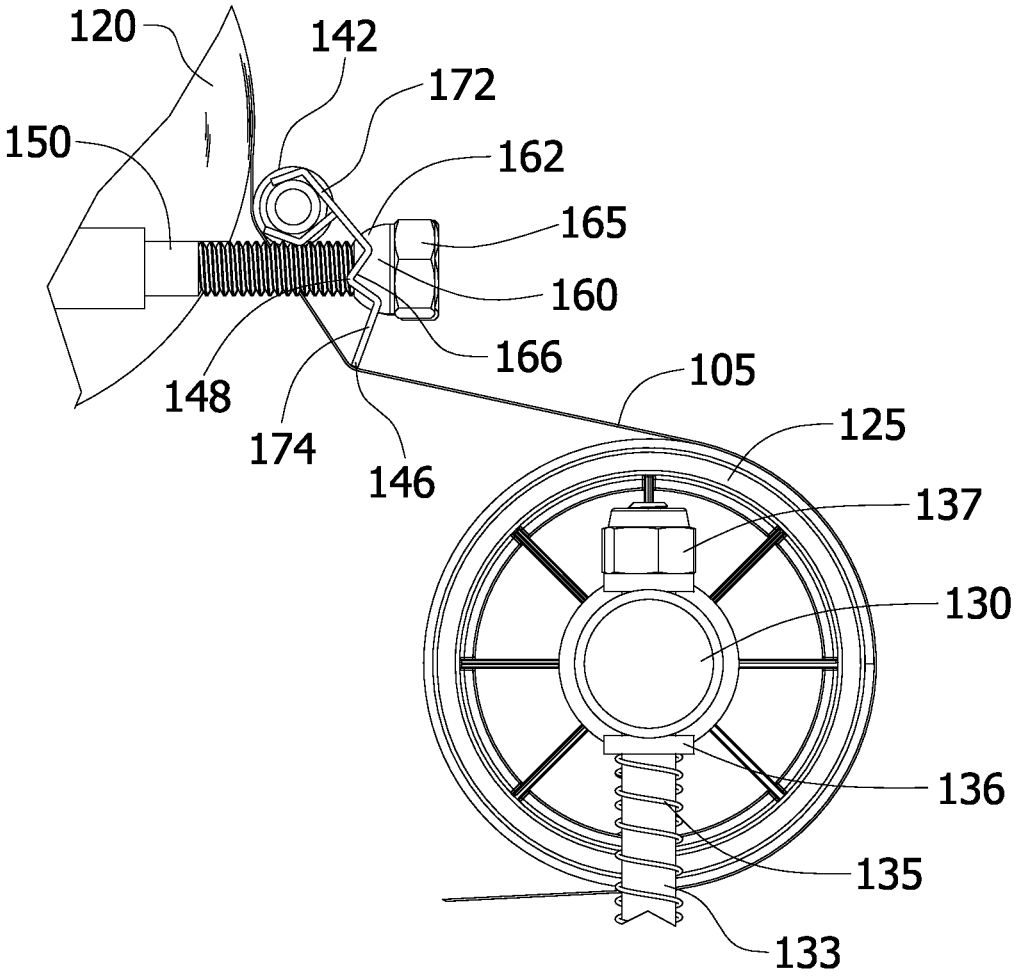
FIG. 5 comprises a side view of the brake arm with a brake roller engaging the roll of the example packaging material dispenser of FIG. 1.

In the illustrated example, the brake arm 140 is supported to rotate to selectively engage the roll 120 with either the at least one brake arm roller 142 of the first edge 144 or the second edge 146. The brake arm 140 is biased to engage the roll 120 on a side of the roll 120 toward the idler roller 145 with the second edge 146 to restrict rotation of the roll 120. For instance, FIG. 3 shows the second or braking edge 146 of the brake arm 140 engaging the roll 120 when the packaging material 105 is not being pulled or dispensed from the roll 120. Turning to FIG. 5, the packaging material 105 is being pulled from the packaging material dispenser 100 thereby producing tension on the packaging material 105 between the roll 120 and the idler roller 125. The tension results in a force where the packaging material 105 pushes the brake arm second edge 146 away from the roll 120, such that the second or brake edge 146 slides over the paper or packaging material 105 as it moves around the idler roller 125. By pushing the brake edge 146 away from the roll 120, the brake arm rotates such that its roller(s) 142 engages the roll 120 to help control the separation of the packaging material 105 from the roll 120. Should the tension in the packaging material 105 be lost, for example, during an uneven rotation of the roll 120 or by an uneven pulling tension being applied to the packaging material 105 during dispensing, the brake arm will rotate in a manner such that the brake edge 146 reengages with the roll 120 to slow and/or stop its rotation. The slowing or stopping of the roll's rotation reduces the amount of packaging material that may dispense from the roll during rotation. This brake mechanism stops the flow of paper almost immediately so that a user does not unroll more material than desired. The brake mechanism is activated by pulling the material forward, which immediately releases the brake so that the material pulls freely from the roll. This is particularly advantageous when the inner core of the roll is uneven, but this approach generally works to quickly and easily dispense the packaging material from the device in an even and controlled process.

Figure 6:
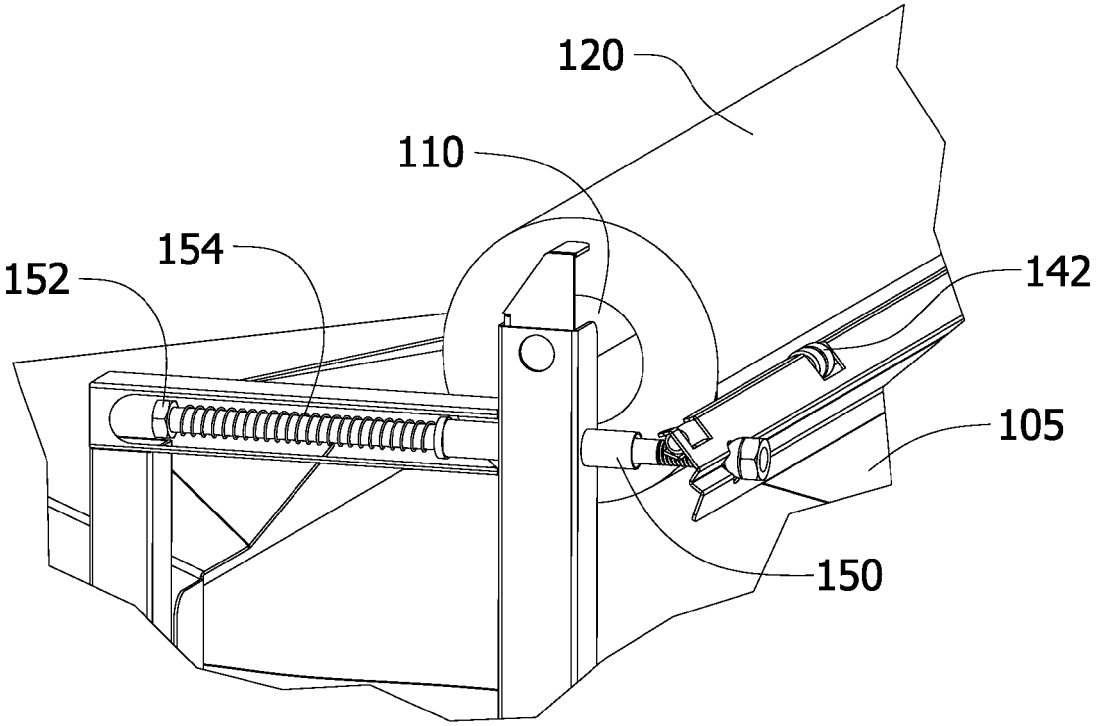
FIG. 6 comprises a perspective view of the brake arm with a brake roller engaging the roll of the example packaging material dispenser of FIG. 1.

In the illustrated example, the brake arm 140 includes a metal body although other materials can be used that provide the friction used to slide over the dispensed packaging material and yet impede or stop the roll's rotation when so engaged. The illustrated brake arm 140 also includes an indented middle portion 148 such that a cross-section of the brake arm 140 resembles the number "3." The brake arm is supported by two posts 150 and 152 configured to engage and support the brake arm 140 and bias the brake arm 140 to engage the roll 120. For example, as illustrated in FIG. 6, the posts 150 and 152 may be biased by a spring 154 configured to attach to an end surface 153 and the post 150 (with similar unillustrated structure operating with the second post 152) to pull the posts 150 and 152, which in turn pull the brake arm 140 towards the roll 120.

Figure 4:
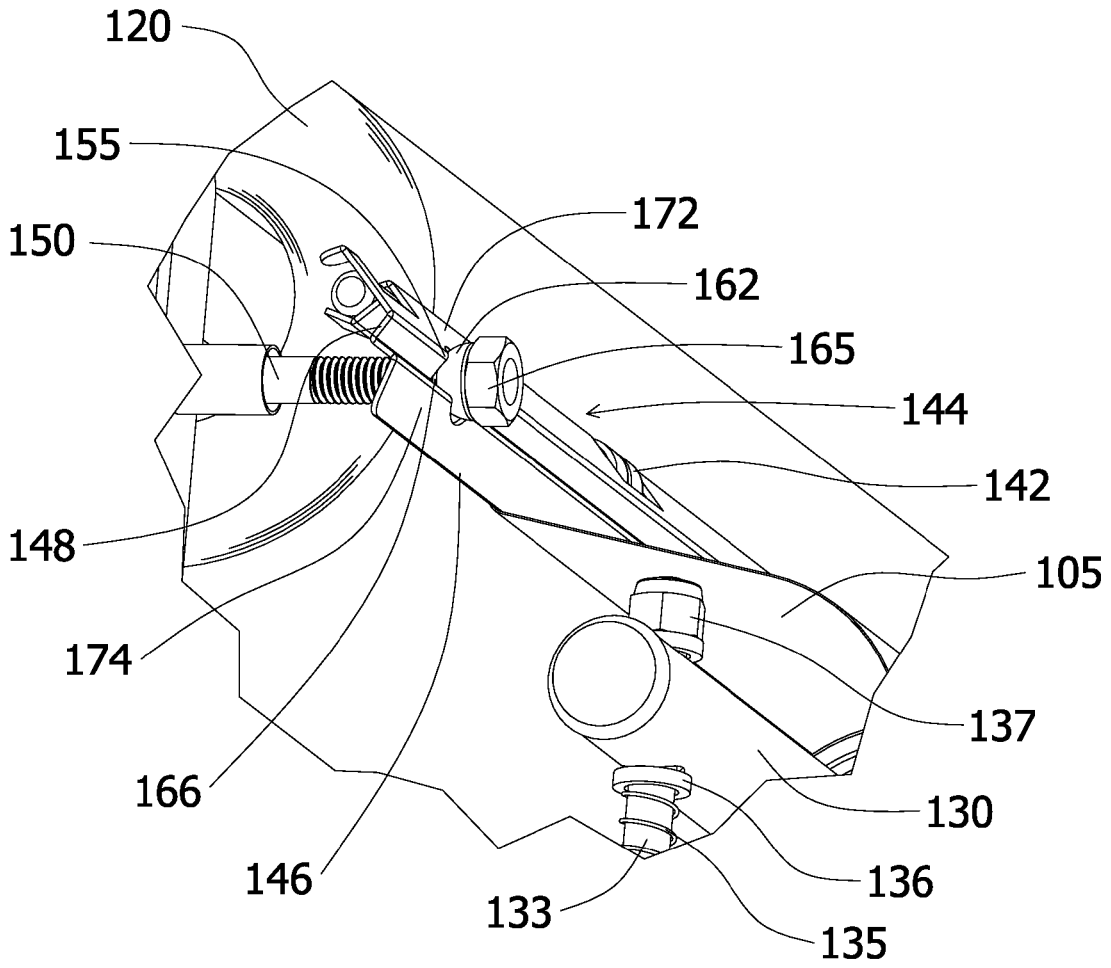
FIG. 4 comprises a perspective view of the engagement of the brake arm to a corresponding support post of the example packaging material dispenser of FIG. 1.

In this case, the brake arm 140 defines two apertures 155 and 157 configured to individually engage the individual ones of the two posts 150 and 152. The two posts 150 and 152 individually define tapered portions 160 to engage the brake arm 140 at the two apertures 155 and 157. The tapered portions 160 begin with a wider portion 162 disposed at a post end 165 that taper down to a smaller width at a tapered portion 166 further down the post 150. The contour of the aperture 155 defined by its location at the middle portion 148 of the brake arm 140 creates several surfaces available to engage different tapered portions 160 of the post 150 as well as possibly an non-tapered portion of the post 150 itself, as illustrated in FIG. 4. For example, when there is reduced tension in the packaging material 105, the aperture 155 portion extending into a first flange 172 of the brake arm 140, which flange 172 terminates in the first edge 144 that supports the rollers 142, allows the aperture 155 to engage the thick portion 162 of the tapered post. The aperture 155 portion that extends into a second flange 174 of the brake arm 140, which second flange 174 terminates in the brake edge 146, allows the aperture 155 part in the second flange 174 to engage further down the post 150 even beyond the tapered portion 160.

Turning to FIG. 5, which illustrates an example where there is tension on the packaging material 105 sufficient to rotate the brake arm 140 brake edge 146 away from the roll 120, the aperture 155 portion extending into the second flange 174 now engages a thick portion 162 of the tapered port while the aperture 155 portion extending into the first flange 172 in turn moves along and may or may not engage the narrowly tapered portion 166 or the non-tapered portion of the post 150.

So configured, through the arrangement of the aperture within the shape of the brake arm and the respective engagement with the tapered nature of the post, the brake arm is biased to engage the roll 120 with the brake edge 146 of the brake arm 140. Whereas, when tension is applied to the packing material 105 to overcome that biasing, the brake arm 140 is rotated to engage the roll 120 with the brake arm rollers 142. Such a configuration can mediate or modulate the occasional uneven forces created during the unrolling and dispensing of packaging materials 105 such as craft paper from its roll 120, which forces may cause unwanted tearing and user dissatisfaction.

Figure 7:
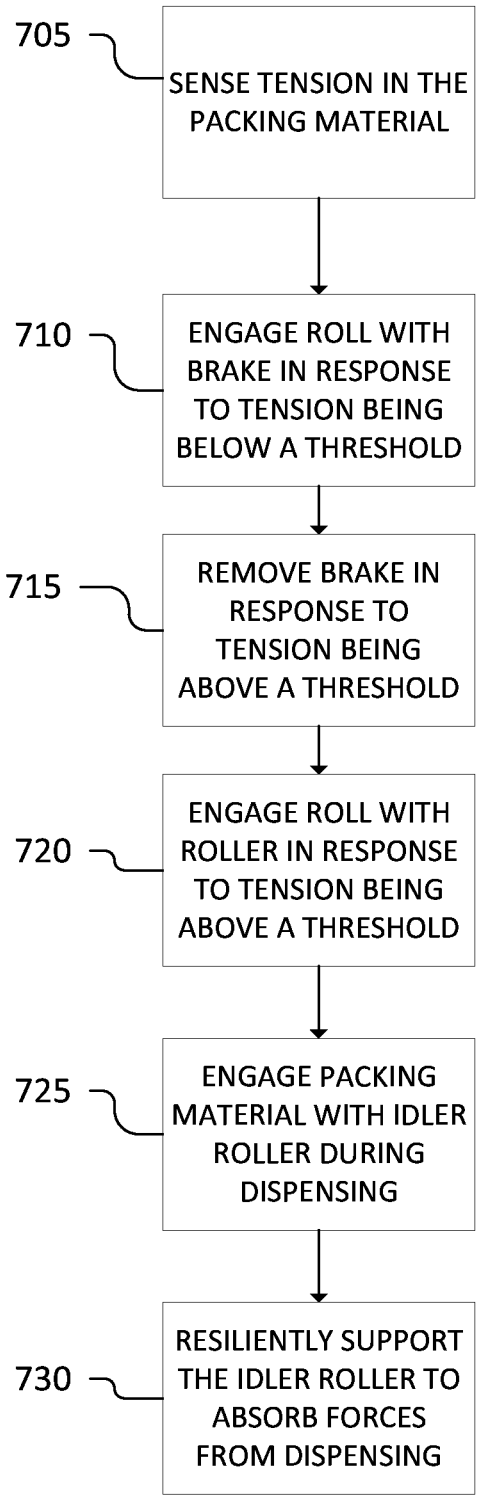
FIG. 7 comprises a flow diagram for an example method of operation of a packaging material dispenser in accordance with various embodiments.

Referring now to FIG. 7, an example method for dispensing packing material from a roll according to these teachings will now be described. In the example, tension in a web of packaging material dispensed from a roll is sensed 705. The method further includes engaging 710 the roll with a brake arm to restrict rotation of the roll in response to sensing that the tension in the packing material is below a threshold. With reference to the above example implementation, the tension is sensed by the brake edge 146 and the threshold is the force needed to overcome the bias force pushing the brake edge 146 to engage the roll. Thus, if the sensed force drops below that threshold, the brake edge 146 will move back into engagement with the roll. On the other hand, the method also includes removing 715 the brake arm from the roll to facilitate rotation of the roll in response to sensing that the tension in the packing material is above the threshold. Optionally, the roll of packing material is engaged 720 with a brake arm roller supported by the brake arm in response to sensing that the tension in the packing material is above the threshold. In the example illustrated above, the device may implement the method by engaging the brake edge 146 with tension in the packaging material 105, which tension overcomes or not the bias force on the brake edge 146. In other embodiments, force sensors can be used for the feedback to control the engagement of the brake edge and/or the rollers.

In another aspect, the method may further include engaging 725 the packing material with an idler roller during dispensing of the packing material from the roll. Further, the idler roller may be resiliently supported 730 to absorb forces imposed on the idler roller by the packaging material during dispensing of the packaging material. The resilient support thereby can absorb some of the excess forces on the packaging material that could cause an undesired tear.

So configured, packaging material can be dispensed from a roll with modulated uneven rotation and other features to decrease undesired tearing of the material. Such an approach can improve efficiency whereby less material is thrown out because of having unwanted tearing. Further, user satisfaction with the device is then improved.

Those skilled in the art will recognize that a wide variety of modifications, alterations, and combinations can be made with respect to the above described embodiments without departing from the scope of the invention. For instance, the profile of the brake arm and tapered portions of the support posts for the brake arm could be modified. Also, brake arm need not extend the length of the paper roll; instead, one or brake portions could be stationed along the roll as long as the feedback regarding paper tension is provided to selectively engage the roll with the brake to ameliorate paper tearing and user frustration with uneven roll rotation. Similarly, the spring based biasing described herein can be accomplished using any number of known biasing structures. Such modifications, alterations, and combinations are to be viewed as being within the ambit of the inventive concept.

What is claimed is:

1. An apparatus for dispensing packing material, the apparatus comprising:

a support arm configured to support a roll of packing material;

an idler roller configured to engage and roll with packing material dispensed from the roll;

a brake arm disposed to extend along a length of the roll, a first edge of the brake arm supporting at least one brake arm roller, a second edge of the brake arm disposed opposite of the first edge, the brake arm supported to rotate to selectively engage the roll with either the first edge or the second edge, the brake arm biased to engage the roll on a side of the roll toward the idler roller with the second edge to restrict rotation of the roll;

wherein the brake arm is configured to rotate to engage the roll with the at least one roller in response to packing material being dispensed from the roll to engage the idler roller.

2. The apparatus of claim 1 further comprising a frame configured to support two posts configured to engage and support the brake arm and bias the brake arm to engage the roll.

3. The apparatus of claim 2 wherein the brake arm defines two apertures configured to individually engage individual ones of the two posts.

4. The apparatus of claim 3 wherein the two posts individually define tapered portions to engage the brake arm at the two apertures.

5. An apparatus for dispensing packing material, the apparatus comprising:

a support arm configured to support a roll of packing material;

a brake arm disposed to extend along a length of the roll to engage the roll with at least one brake arm roller during dispensing of packing material from the roll;

wherein the brake arm comprises:

a first edge supporting the at least one brake arm roller, and a second edge of the brake arm disposed opposite of the first edge and comprising a brake edge;

wherein the brake arm is configured to engage the roll with the brake edge in response to uneven rolling of the roll on the support arm.

6. The apparatus of claim 5 wherein the brake arm is supported to rotate to engage the roll with either the at least one brake arm roller of the first edge and the second edge and the brake arm is biased to engage the roll with the second edge to restrict rotation of the roll.

7. The apparatus of claim 5 further comprising a frame configured to support two posts configured to engage and support the brake arm and bias the brake arm to engage the roll.

8. The apparatus of claim 7 wherein the brake arm defines two apertures configured to individually engage the individual ones of the two posts.

9. The apparatus of claim 8 wherein the two posts individually define tapered portions to engage the brake arm at the two apertures.

10. A method for dispensing packing material from a roll, the method comprising:

biasing a brake arm comprising a first edge supporting the at least one brake arm roller, and a second edge of the brake arm disposed opposite of the first edge and comprising a brake edge to engage a roll of packing material with the brake edge;

rotating the brake arm tension in the packing material sufficient to rotate the brake arm, the rotating effecting moving the brake edge away from the roll and engaging the roll with at least one of the at least one brake arm roller.

11. The method of claim 10 further comprising rotating the brake arm to engage the roll with at least one brake roller during dispensing of the packing material from the roll by engaging the brake edge with tension in the packaging material.

12. The method of claim 10 further comprising resiliently supporting the brake arm roller to absorb forces imposed on the brake arm roller by the packaging material during dispensing of the packaging material.

* * * * *